United States Patent [19]

Lanzillotti et al.

[11] 4,347,855

[45] Sep. 7, 1982

[54] METHOD OF MAKING SMOKING ARTICLES

[75] Inventors: Harry V. Lanzillotti, Midlothian; George H. Burnett, Richmond; Alline R. Wayte, Richmond; Thomas S. Osdene, Richmond; Warren E. Claflin, Bon Air; A. Clifton Lilly, Jr., Richmond; John F. Nienow, Midlothian, all of Va.

[73] Assignee: Philip Morris Incorporated, New York, N.Y.

[21] Appl. No.: 303,519

[22] Filed: Sep. 18, 1981

Related U.S. Application Data

[63] Continuation of Ser. No. 171,314, Jul. 23, 1980, abandoned, which is a continuation-in-part of Ser. No. 148,124, May 9, 1980.

[51] Int. Cl.[3] ..... A24B 3/14

[52] U.S. Cl. ..... 131/78; 131/79; 131/360

[58] Field of Search ..... 131/77–80, 131/84 R, 85, 86, 119, 280, 352–359, 369–375, 66 R, 66 A, 70, 331, 336, 347, 360–368

[56] References Cited

U.S. PATENT DOCUMENTS

| | | | |
|---|---|---|---|
| 235,885 | 12/1880 | Lindsley | 131/86 |
| 235,886 | 12/1880 | Lindsley | 131/86 |
| 346,025 | 7/1886 | Cook | 131/86 |
| 1,437,956 | 12/1922 | Blair | 131/8 R |
| 1,559,322 | 10/1925 | Hohn | 131/77 |
| 1,778,482 | 10/1930 | Burns | 131/8 R |
| 2,349,551 | 5/1944 | Helm | 131/8 R |
| 2,485,670 | 10/1949 | Sowa et al. | 131/140 C |
| 2,598,680 | 10/1950 | Frankenburg | 131/140 C |
| 3,085,580 | 4/1963 | Muth | 131/140 C |
| 3,096,772 | 7/1963 | Körber | 131/66 |
| 3,098,492 | 7/1963 | Wurzburg et al. | 131/140 C |
| 3,203,432 | 8/1965 | Green et al. | 131/140 C |
| 3,209,763 | 10/1965 | Parmele et al. | 131/77 |
| 3,223,090 | 12/1965 | Strubel et al. | 131/140 C |
| 3,260,265 | 7/1966 | Oster | 131/66 |
| 3,349,779 | 10/1967 | Bell et al. | 131/8 R |
| 3,364,935 | 1/1968 | Moshy | 131/140 C |
| 3,373,751 | 3/1968 | Wallberg | 131/140 C |
| 3,404,691 | 10/1968 | Moshy et al. | 131/140 C |
| 3,410,279 | 11/1968 | Moshy et al. | 131/140 C |
| 3,516,417 | 4/1968 | Moses | 131/8 R |
| 3,528,434 | 9/1970 | Halter et al. | 131/140 C |
| 3,529,602 | 9/1970 | Hind et al. | 131/2 |
| 3,738,374 | 6/1973 | Bennett | 131/2 |
| 3,756,249 | 9/1973 | Selke et al. | 131/9 |
| 3,774,622 | 11/1973 | Steigerwald | 131/10 A |
| 3,840,028 | 10/1974 | Yatrides | 131/253 |
| 3,863,644 | 2/1975 | Hunt | 131/9 |
| 3,905,377 | 9/1975 | Yatrides | 131/9 |
| 3,932,081 | 1/1976 | Buchmann | 131/140 C |
| 4,027,679 | 6/1977 | Kaswan | 131/8 R |
| 4,126,309 | 10/1978 | Brantl et al. | 131/170 R |
| 4,142,534 | 3/1979 | Brantl | 131/8 R |

FOREIGN PATENT DOCUMENTS

| | | | |
|---|---|---|---|
| 1167717 | 4/1964 | Fed. Rep. of Germany | 131/140 C |

*Primary Examiner*—V. Millin

[57] ABSTRACT

A method of making smoking articles wherein a combustible tobacco material is mixed with one or more other ingredients including a liquid, the mixture being subjected to further processing to produce a shaped coherent mass having a through passage. Shaping is effected by application of pressure to the mixture to form the coherent mass, and is followed by drying of same, the mixture composition being selected and the shaping pressure and drying being controlled to impart to the shaped mass a porosity and density such as to substantially occlude gas flow therethrough and a porosity sufficient to support combustion of the shaped mass when ignited.

59 Claims, 7 Drawing Figures

FIG. 2
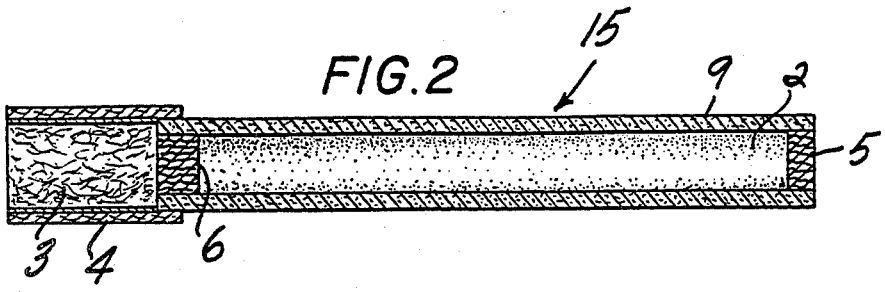
FIG. 3
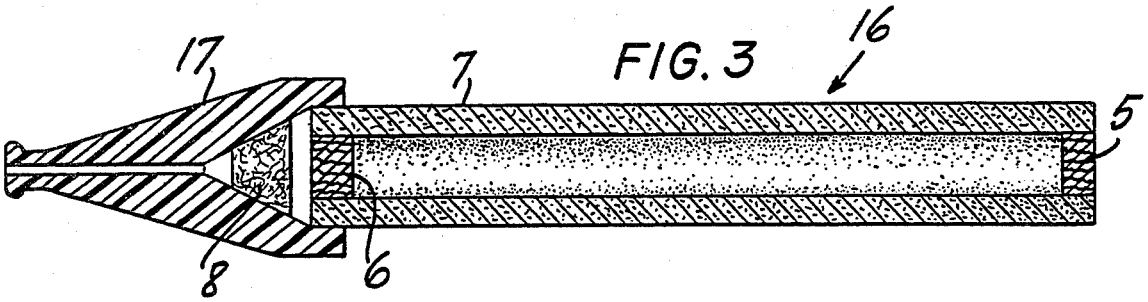
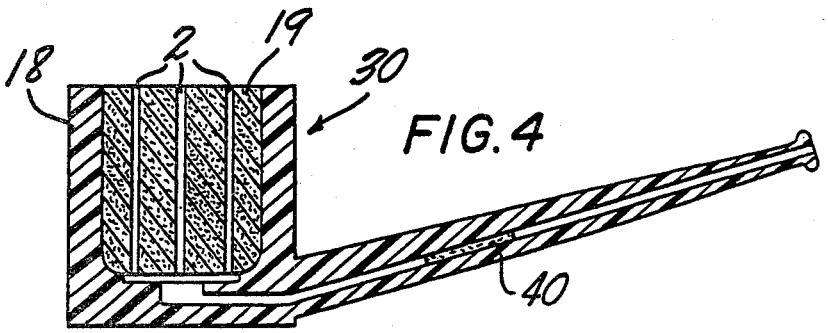
FIG. 4
FIG. 5
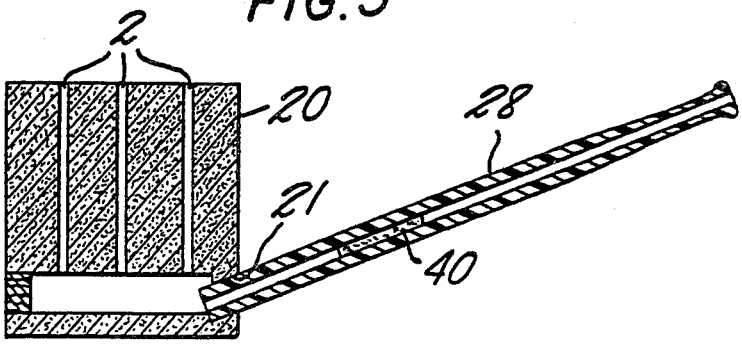

METHOD OF MAKING SMOKING ARTICLES

CROSS-REFERENCES TO RELATED APPLICATIONS

This is a continuation of commonly assigned, copending application Ser. No. 171,314, filed July 23, 1980, now abandoned which is a continuation-in-part of commonly assigned copending application Ser. No. 148,124, filed May 9, 1980.

BACKGROUND OF THE INVENTION

The present invention relates to a manufacture of tobacco-containing smoking articles, and, in particular, to making of such articles whose physical properties can be adjusted, thereby modifying their combustion properties so as to permit control of tar delivery by the article during smoking.

Commonly assigned copending application Ser. No. 148,124, filed May 9, 1980, discloses tobacco-containing smoking articles wherein tar delivery during combustion is controlled by adjusting the density, porosity, surface area and/or composition of the article. These smoking articles are described in such copending application as comprising a coherent mass of combustible tobacco material. The mass of combustible material is further described as having at least one through passage extending from a first opening in the mass surface to a second opening remote from the first and as being of a density and porosity such as to substantially occlude gas flow therethrough, while also being of a porosity sufficient to support combustion of the mass when ignited.

Smoking articles having characteristics as abovedescribed, allow for control of tar delivery as a result of their controlled influence on pyrolysis which is the primary cause of tar production. Pyrolysis may be defined as the thermal evolution of tars and gases by heat produced from the combustion of a carbonaceous incandescent coal. As pyrolysis reduces smoking material to its carbonaceous skeleton, the carbonaceous remains, in turn, combust and provide heat for further pyrolysis of fresh material located adjacent to the combusting material.

As compared to smoking articles of the aforesaid copending application, conventional smoking articles of the type comprising shredded tobacco leaf, shredded reconstituted tobacco sheet, tobacco stems and combinations thereof do not provide similar pyrolysis control. In such conventional articles, a relatively large surface area is available for pyrolysis, and the latter occurs due to the heat of conduction and radiation from the coal, as well as due to heat transferred to noncombusted tobacco adjacent the coal by gases heated by passage through the coal.

Additionally, conventional smoking articles of the above-mentioned type effect different temperature control of heated gases as they progress down the article. Thus, in conventional articles substantial heat dissipation occurs in regions immediately adjacent the coal, thereby reducing the heat of such gases to the point where they no longer can be used to effect thermal release of flavorants downstream of the coal. However, with the articles of the aforesaid copending application, heat reduction is significantly less, thereby permitting downstream thermal flavorant release.

It is an object of the present invention to provide a method for making tobacco articles of the type described in the aforesaid copending application.

SUMMARY OF THE INVENTION

In accordance with the principles of the present invention, the above and other objectives are realized in a practice wherein a combustible tobacco material is mixed with one or more other ingredients including a liquid, the mixture being subjected to additional processing to produce a shaped coherent mass having a through passage, the mass being of a density and porosity such as to substantially occlude gas flow therethrough, while also being of a porosity sufficient to support combustion thereof. In accordance with the invention, shaping is effected by application of pressure to the mixture to form the coherent mass; subsequently the formed or shaped mass is dried.

Preferably, formation of the coherent mass is effected by extrusion of the tobacco mixture, the mixture for purposes of extrusion preferably containing comminuted tobacco of mesh size less than about 30 mesh and of sufficient amount to provide a solids content of the mixture of about 55 to 75 weight percent solids.

In a further aspect of the invention, improved characteristics are realized by further processing of the dried coherent mass, such further processing including rewetting of the mass and subsequent redrying of same.

In yet a further aspect of the present invention, the practice is further expanded to provide for the disposition of an easily ignitable air permeable plug in the passage of the coherent mass. When practiced in conjunction with the preferred extrusion process, it is preferable that the plug be extruded concurrently with the coherent mass.

BRIEF DESCRIPTION OF THE DRAWINGS

FIGS. 2–5 illustrate various smoking articles producible with the method of the present invention;

DETAILED DESCRIPTION

Figure 1:
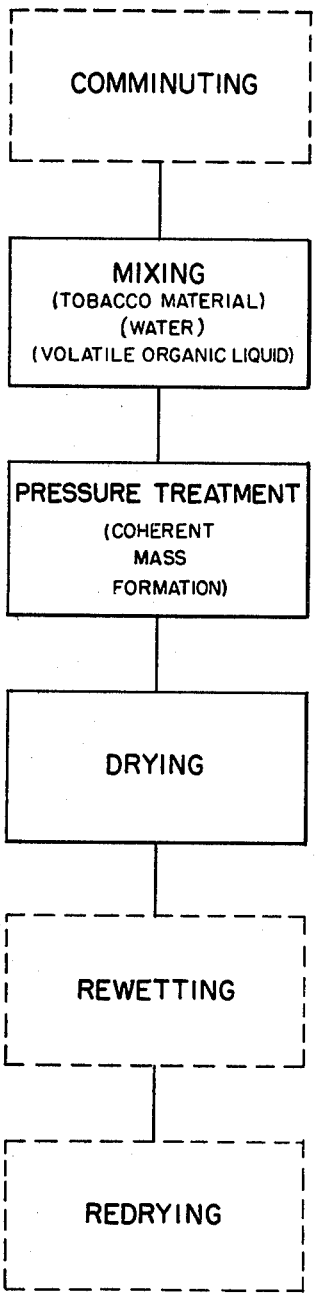
FIG. 1 shows a flow diagram involved in manufacture of a smoking article in accordance with the present invention.

In accordance with the present invention and as depicted in FIG. 1, tobacco articles are formed by first mixing a quantity of tobacco containing material with water and with a volatile organic liquid to provide a tobacco mixture suitable for subsequent processing, i.e., shaping to provide a shaped mass in any one of a number of discrete forms. The tobacco containing material might comprise high quality, highly flavored tobacco, such as bright, Burely, Oriental or mixtures thereof. Other tobacco materials such as reconstituted tobaccos and prepyrolyzed tobaccos may also comprise the tobacco containing material.

Generally the tobacco materials to be mixed will have a moisture content in the range of about 5 to 15% OV, and preferably 10% OV. As used herein, the term OV (oven volatiles) represents the moisture content of tobacco determined as percent oven volatiles. OV is determined by placing a weighed sample of tobacco in an air-circulating oven and maintaining the sample in the oven at a temperature of 100° C. for a period of 3 hours after which the sample is again weighed. The difference in the two weight values expressed as a percentage of the original weight is defined as OV.

Prior to mixing, the tobacco may be comminuted to a desired particle size. Conventional means, such as a ball mill, a plate or disc-type colloidal mill or blendor, may be used to effect comminution. The time required to accomplish this will, of course, depend on the original size of tobacco components to be comminuted and to some extent on the type of tobacco used as well as the moisture content thereof.

Mixing of the tobacco with the liquid ingredients may be effected with conventional equipment. For example, conventional Hobart mixers equipped with a flat paddle or beater-type blade, ribbon-type mixers and the like or any other mixer that will effect a homogenization or even distribution of liquid to tobacco is suitable.

In the mixing operation the addition of liquid ingredients to the tobacco particles may be simultaneous or the water may be added first followed by addition of the volatile agent. Mixing generally is accomplished at room temperature and generally is effected in a closed container to prevent premature volatilization of the organic liquid. The time necessary to achieve even distribution of the liquid and tobacco particles depends to a great extent on particle size as well as the type of liquid combination used. Generally 15 minutes to several hours is sufficient to obtain the desired distribution of liquid.

The volatile organic liquid of the mixture serves to improve the density and porosity characteristics of the final smoking article, possibly due to rapid vaporization during drying. The organic liquids which may be employed are preferably those having a higher vapor pressure than water and include only those liquids which are compatible with tobacco products. For purposes of this application, liquids are compatible with tobacco if they do not appreciably react with tobacco constituents and in addition mix sufficiently with the tobacco material so as to avoid separation during the article forming operation. Further, it is preferable to employ liquids, which when mixed with tobacco products, do not adversely affect the aromatic or subjective qualities thereof on smoking. Preferred liquids include those which may easily be removed by evaporation under relatively non-drastic heating or drying conditions and which upon evaporation leave no appreciable residue. Among the suitable organic liquids are straight or branched-chain hydrocarbons of about 5 to 8 carbon atoms, such as the pentanes, hexanes and heptanes. Straight or branched-chain alcohols selected from 1 to 8 carbon atoms and including methanol, ethanol, propanol, isopropanol, butanol and the like are also suitable for us. Moreover, the "Freon" liquids including trichloromonofluoromethane and dichlorodifluoromethane may be used. Selected ketones, e.g., methyl ethyl ketone, ethers, halohydrocarbons and the like, may be used in some instances. The selected liquid may be used alone or, in some instances, a combination of two or more agents may be used depending on the type of smoking article being produced.

The ratio of total water in the mixture to volatile organic liquid will depend to some extent on the type and mesh of tobacco and the specific liquid being used but generally will be in the range of about 6 parts water to 1 part organic liquid to about 1:1 ratio of each. Where less than −60 mesh tobacco is employed in accordance with the preferred forming practice discussed hereinbelow, a ratio of about 2 parts water to 1 part organic liquid is preferred.

It may also be desirable to add filler materials to the aqueous tobacco mixture. Filler materials can include calcium carbonate, selected carbon materials, diatomaceous earth, attapulgite and the like. Up to about 40–50% of the solids in the mixture may comprise such fillers without requiring addition of binders. If desired, burn additives may also be added to the mixture to adjust burn properties.

When all the desired ingredients have been added, and an homogeneous mixture is obtained, the thus prepared mixture is ready for further processing to produce smoking articles. By this further processing, the tobacco mixture is formed into a shaped article comprised of a coherent tobacco mass whose density and porosity are sufficient to occlude gas flow therethrough and whose density is sufficient to support combustion of the mass when ignited. The mass density is further provided with at least one passage extending therethrough from a first opening on the mass surface to a second opening remote from the first opening. Providing of such passage as used herein means providing same during the shaping operation and or during operations subsequent thereto, or during both shaping and such subsequent operations.

In accordance with the invention, the article shaping operation includes pressure treatment of the mixture to transform the mixture into a coherent or self-supporting tobacco mass and subsequent drying of the mass. The pressure treatment will generaly require application of pressure to the tobacco mixture when situated in a confined space and, preferably, results in a coherent mass having the desired through passage, which is assumed to be the case in the flow diagram of FIG. 1. An alternate procedure would be to form the mass without the passage and to subsequently create the passage after the pressure treating operation, or after drying, by a material removal operation such as, for example, boring or drilling.

The pressure treatment can be effected by any one of a number of conventional techniques adapted to provide sufficient pressure to the tobacco mixture to cause release of the tobacco material binding agents therein resulting in a cohesive mass. The pressure forming operation thus enables self-supporting articles to be produced without the need to add binders to the tobacco mixture.

While pressure treatments such as molding can be used to implement the invention, a preferable treating technique is extrusion. In general, extrusion conditions will depend upon the type of extruder used (ram, screw, etc.), the particular composition of the tobacco mixture and the desired shape, density and porosity conditions for the resultant extrudate.

Conventional screw extruders or higher pressure producing ram extruders may be employed, with the die heads of these extruders preferably having the desired shape of the smoking articles to be produced. These extruders may be operated at selected pressures and with selected cooling of one or more sections of the extruder barrel to promote production of the extrudate. An extruder found suitable is a Wayne plastics extruder equipped with a 1:1 screw adapted to rotate at 1 to 120 rpms. Such an extruder, due to its 1:1 screw, does a minimum of work on the tobacco mixture, while providing pressure sufficient to release the natural binding agents of the tobacco and thereby result in a cohesive product. With screw extruders of this type, extrudate pressures at the end of the extruder barrel (i.e., melt pressures) of up to 2500 psig are useable, with pressures of up to 1200 psig being preferable. Extrudate temperatures at such barrel end (i.e., melt temperatures) of less than about 40° C. also are useable and can be developed by maintaining the screw barrel temperature in the range of about 20° to 25° C.

Preferable tobacco mixture conditions for extrusion are a tobacco particle size of preferably below about 30 mesh and a tobacco content sufficient to produce a mixture having a solids content in the range of about 55 to 75 weight percent solids, and preferably about 60–70 percent solids.

As above indicated, the shape of the desired smoking articles controls the extruder die head construction. Preferable smoking articles are of hollow cylindrical shape and, more preferably, are cylindrical tubes having a wall thickness such that the cross-sectional area of the mass is less than the corresponding cross-sectional area of the passage. Die heads having a suitably adapted annular extrusion passage are thus employed to achieve this construction. A particular extruder for realizing hollow cylinders is the aforementioned Wayne extruder. Specifically thin-walled tobacco tubes having a high density and low porosity and which burn with coal temperatures in the range of 585° C. to 785° C. may be produced with suitably modified extruders of this type. Additionally, when using such extruders it is customary to introduce air flow into the inner parts of the formed tube to prevent collapse thereof.

Forming part of the article pressure treating operation may be a severing or separating operation which results in the production of individual coherent masses corresponding to individual smoking articles. Such an operation is necessary if pressure treatment is not itself on an individual article basis. In the case of the abovedescribed preferred extrusion practice, wherein the extrudate will typically be a single cohesive continuous length mass exiting from the extruder die, it is desirable to perform a cutting operation at the die exit, thereby to form individual units of length corresponding to that of the desired smoking articles. Where articles of preselected length are desired, the cutting operation is synchronized with the rate of extrudate output to provide the required length.

The aforesaid operation of providing individual units, also may be effected subsequent to the drying of the extrudate, if severing of the dried extrudate is found to be a more acceptable practice.

Drying the resultant pressure-formed coherent mass may be accomplished either by simple evaporation at ambient environment, e.g., room temperature or by application of heat. Typically, at a room temperature of from about 70° to 75° F. typical drying times might range from about 12 to 24 hours. Heat application might be at a temperature of about 100° C. This might be by conventional heating means such as a Freas oven (forced air oven) over a period of time from about 15 minutes to 1 hour. Heating might also be accomplished more rapidly by microwave application in which case the time of application will depend upon the power used. At power levels above about 150 watts drying times of about 2 minutes have been found acceptable. Such rapid drying might be employed to enhance the static burn properties of the resultant smoking article.

Following the drying operation, the dried articles may be further processed as by affixing the articles to suitable mouthpieces which may or may not include filters to result in the completed smoking article construction. FIGS. 2–5 illustrate typical completed smoking articles which may be formed by the process of the invention. FIG. 2 shows the completed article 15 comprised of an elongated coherent mass 9 shaped as a tubular rod having a passage 2 extending end to end thereof. While the mass 9 may itself serve as a smoking article, it is shown in FIG. 2 as provided with a filter 3 at the smoking end, the latter being joined to the mass 9 with tipping paper 4 in conventional manner. Furthermore, while the mass 9 is of circular configuration, various other sectional geometrics could be employed, these, as above-noted, being pressure formable by utilizing in the preferred extrusion process various analogues die head geometries. In FIG. 3, the smoking article has the form of a cigar 16 wherein the walls 7 of the tubular mass are of greater thickness relative to the size of the article and as compared with the FIG. 2 smoking article. In this case, the cigar is fitted with a mouthpiece 17 which itself embodies a filter means 8.

In FIGS. 4 and 5, the smoking article made by the process of the invention is utilized in a conventional smoking pipe or as a pipe shaped component as such. The smoking article 30 shown in FIG. 4 is formed as a relatively truncated mass 19 shaped and sized for reception in the bowl of pipe 18, with the mass being provided with one or more through passages 2 extending from top to bottom thereof. FIG. 5 shows the manner in which a coherent mass 20 is shaped in the form of a smoking pipe bowl and like the FIG. 4 mass has one or more passages 2 and is fitted with a side opening as at 21 for reception of a pipe stem 28 provided with a filter 40 as is the stem of pipe 18.

While the method of the invention as described above has been found to provide suitable smoking articles as evidenced by the examples set forth hereinbelow, a further aspect of the invention is to provide further processing of the pressure-formed coherent mass subsequent to the initial drying operation. Such further processing enables changing of the porosity of the dried mass, whereby improved combustion characteristics of the resultant smoking product result. This further processing comprises rewetting the dried mass and subsequent redrying of same. Rewetting may be carried out by spraying or immersion of the dried mass. Suitable rewetting has been carried out by immersing the mass in a bath of liquid, preferably, water, for a time sufficient to obtain the desired change in porosity. In general rewetting conditions will depend upon inital porosity, tobacco particle size and the type of organic fluid used. Suitable rewetting conditions to realize desired porosity changes can be determined through empirical procedures. Subsequent redrying after the rewetting is preferably carried out in accordance with the initial drying procedure discussed hereinabove.

In a further aspect of the method of the invention, the method is further modified to allow for disposition of a readily ignitable air permeable plug in the through passage of the pressure-formed coherent mass. Plugs may be placed at one or more positions along the mass passage and in blocking relation thereto. In the preferred practice of the present invention wherein cylindrical tubular smoking articles are formed, it is desirable to situate such plugs at opposite ends of the tubular passage. This is illustrated in FIGS. 2 and 3 by the plugs 5 and 6. Plugs serve both to aid ignition and as baffles to prevent flash jetting through the tube due to suction on ignition or in the event of relighting.

Plug material may take various forms and may contain flavorants releasable upon heating. Plug material preferably comprises comminuted tobacco prepared in the same manner as the coherent mass forming the smoking article. Plugs can, therefore, be formed using the analogous procedure outlined above for the coherent mass, with pressure treatment, of course, modified to result in plugs of desired configuration and suitable for insertion in the coherent mass in passage blocking relation. Air permeability for the plugs may be realized either through the inherent porosity of the plug material or by through orifices provided in the plug during or after plug formation.

While plugs might be formed independently of the coherent mass and inserted in the mass subsequent to its formation or subsequent to drying, in preferred practice plugs are formed and situated in the mass passage simultaneously or concurrently with mass formation. In yet further preferred practice, this is accomplished in the preferred extrusion procedure by co-extruding the plug with the mass in suitably time relationship so as to obtain plugs of desired size at desired passage blocking positions and in intimate contact with the inner mass wall.

Figure 6:
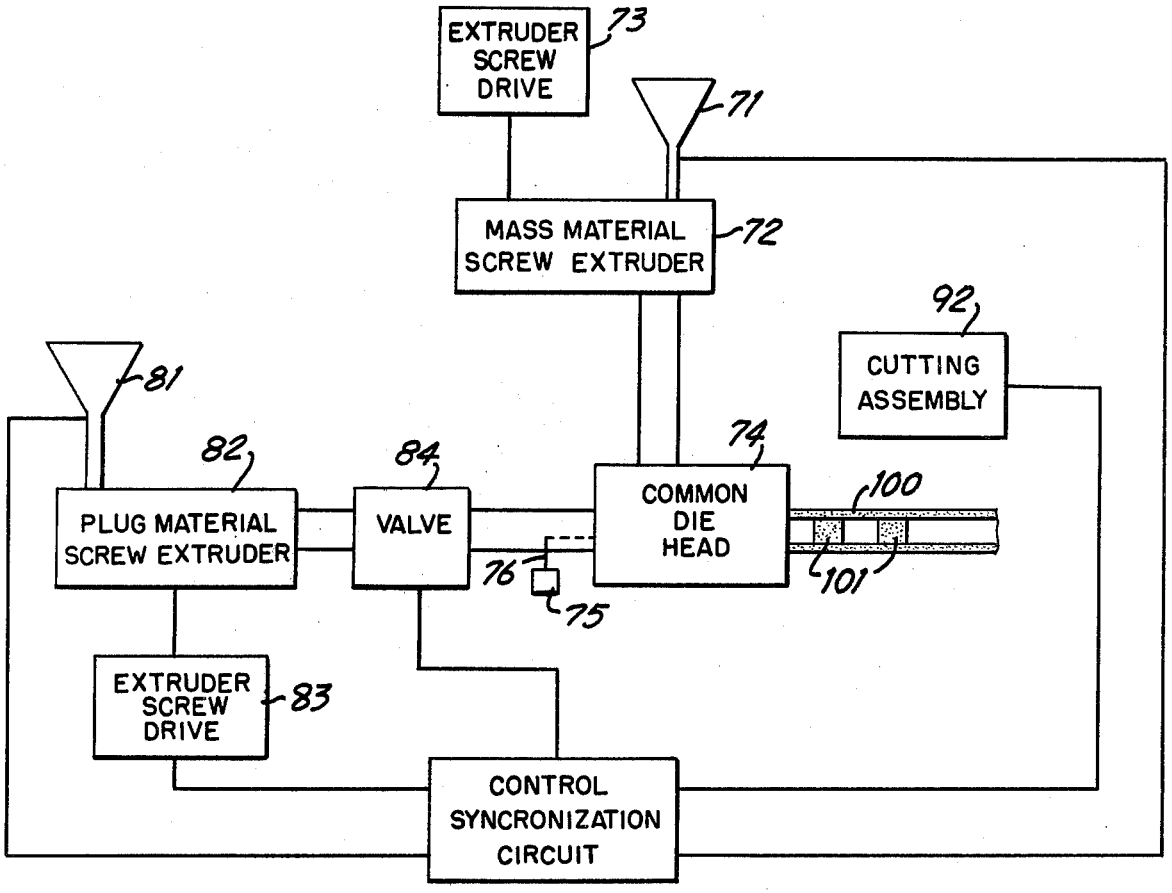
FIG. 6 shows in schematic fashion extrusion equipment for performing the extrusion step of the method of the invention.
Figure 7:
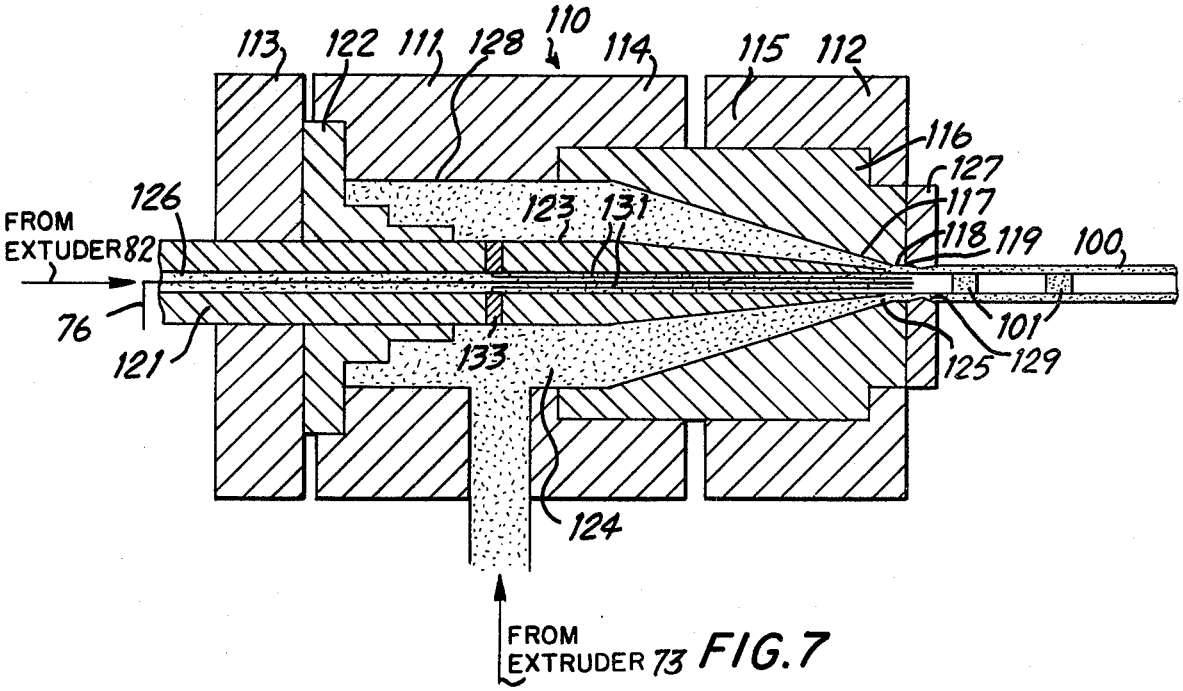
FIG. 7 shows a die head for the extrusion equipment of FIG. 6.

FIG. 6 shows schematically extrusion equipment for providing the aforesaid co-extrusion of a tubular coherent mass and plugs in accordance with the method of the invention, the die head construction being shown in greater detail in FIG. 7. Turning to FIG. 6, a tobacco mixture as above-described for forming the coherent mass or body of the smoking article is supplied to an automatic hopper feeder 71. The hopper 71 applies a continuous force to the tobacco mixture via a rotating blade which extends into a material receiving port of a screw extruder 72 driven by a drive 73. The tobacco mixture is thereby force fed to the extruder 72 and the extrudate developed in the extruder is forced thereby into a common die head 74 where it is formed into a tubular coherent mass 100 at the die head exit. Air also is supplied to the die head 74 from a source 75 and is conveyed by a line 76 to the die head exit interiorly of the tubular mass 100 to prevent collapse thereof as the mass is being formed.

Plug material of similar composition to the mass material is supplied to a hopper feeder 81 having a construction analogous to that of hopper feeder 71. The plug material is fed by hopper 81 to a plug crew extruder 82 which is driven by a drive 83. Extrudate passes from the extruder 83 through the valve 84 into the common die head 74 where it is made available interiorly of and joined to the inner wall of the tubular mass 100.

Control synchronization circuit 91 effects control of the continued pressure applied to the plug extrudate in passing to the head 74. This control is synchronized with the issuance of the tube 100. Circuit 91 maintains the valve 84 closed and the drive 83 stopped for a predetermined period of time corresponding to the delivery of a preselected length of tube. After such time the valve 84 is opened and the drive 83 restarted, causing pressure to be applied to the plug extrudate and, as a result, common delivery of plug and tube. This condition lasts for a second predetermined period of time corresponding to the common delivery of a preselected length of tube and plug, after which the valve is again closed and the drive 83 is again stopped. Repeated control of the valve 94 and drive 83 thus results in the tube 100 being continuously extruded with plugs 101 of determined length being disposed at determined space positions therein and in passage blocking relationship thereto.

Control synchronization circuit 91 also controls the direction of rotation of the blades of the hoppers 81 and 71. This direction is changed periodically by the circuit 91 to ensure proper delivery of tobacco mixture to the respective screw extruders.

Also shown in FIG. 6 is a cutting assembly 92 at the die head exit which also is synchronously operated by the control circuit 91 to cut the tube 100 into individual coherent mass units. Such cutting operation can by synchronized to occur immediately before disposition of a plug 101, whereby each unit will contain a single plug at the forward passage thereof. Preferably, however, the cutting assembly is controlled to effect cutting so that units are produced having plugs at both ends. This is realized by controlling the plug extruder operation to issue plug material of desired length and by correspondingly controlling the cutting assembly to sever the tube 100 at positions along the length of each extruded plug.

FIG. 7 illustrates the common die head 74 of FIG. 6 in greater detail. As illustrated die head 74 includes an outer casing or support assembly 110 comprised of a central hollow cylindrical body 11 to whose opposite ends are attached by screws (not shown) support rings 112 and 113. A central recessed section 114 of the body 111 cooperates with a facing central recessed section 115 of the ring 112 to support a first hollow mandrel 116. Inner conical surface 117 of mandrel 116 extends to a short cylindrical guide surface 118, the latter surface 118 terminating at the end of ring 112 to define an exit orifice 119.

A further hollow mandrel 121 is supported by ring 113 and by a hollow retainer element 122 held between the latter ring and body 111. The mandrel 121 extends the length of the assembly 110 and the mandrel outer surface 123 is spaced from the respective inner surfaces 128 and 117 of body 111 and mandrel 116. These surfaces (123, 128, 117) define an annular passage 124 for receipt of the tubular mass extrudate from the extruder 73. Surface 123 is tapered inwardly in the region of the surface 117, both surfaces cooperating to provide an exit annular passage 125 of radial expanse corresponding to the thickness of the tubular mass to be formed and of outer diameter commensurate with the guide surface 118.

A central bore 126 extends the length of mandrel 121 and receives plug extrudate from the extruder 82. Bore 126 at the end of mandrel 121 is of expanse substantially equal to that of the inner diameter of the exit passage 125, whereby plug extrudate of such expanse is delivered to the end of the exit passage. Air line 76 passes through the bore 126 and delivers air to the region adjacent the passage 125 and the exit port 119 to prevent collapse of the tube 100 as it is being extruded.

In operation, pressure applied to the tubular mass extrudate via the extruder 73 forces the extrudate into the passage 124 and thence to the exit annular passage 125. The extrudate departs the passage 125 as the thin walled tubular coherent mass 100, the latter mass being guided by cylindrical surface 118 to exit port 119. With no pressure applied to the plug extrudate by the extruder 82, the tubular mass 100 exits without plug material and passes through a constriction ring 127 attached to the mandrel 116.

Upon pressure being applied to the plug extrudate by the extruder 82, the extrudate is forced through the central bore 126 and supplied to the end of the annular passage 125 where it is received interiorly of and in contact with the inner wall of the simultaneously formed tubular mass 100. As pressure continues to be applied to the plug extrudate, the plug extrudate and the tubular mass together pass through exit port 119 into the central orifice 129 of the ring 127. The latter orifice tapers inwardly and thereafter outwardly, the inward taper ending at a radial expanse which is less than the outer diameter of the tubular mass. Upon reaching the end of the inward taper, the forward end of the tubular mass is inwardly constricted forcing its wall into cohesive engagement with the forward end of the plug extrudate. At this time, the pressure applied to the plug extrudate terminates, and the tubular mass which continues to be extruded and is now joined to the plug extrudate breaks from the plug extrudate a plug 101 which continues to move with the tube through the orifice 129. The portion of the tube coextensive with the plug is thereupon continuously constricted over further incremental areas, thereby cohesively joining the plug to the tube wall over the entire plug length. In this way the tube and plug are joined without excessive drag being placed on the tubular mass, whereby thickening of the tube wall is prevented during the joining operation.

It should be noted that cohesive joining of the plug 101 and the tubular mass 100 can be effected in other ways such as, for example, by expanding the plug by known methods so it cohesively joins to the mass wall.

As noted above, air-permeability of the plugs 101 can be brought about in the plug forming operation and it is contemplated that the die head of FIG. 7 can be modified to provide through orifices in the plugs as they are being extruded. This can be accomplished by the placement of spaced thin solid rods 131 in the bore 126, such rods extending from a point in the bore to beyond the annular passage 125. These rods might be held by a ring 133 which can be placed between sections of the mandrel 121, thereby placing the rods in their desired position in the bore 126.

EXAMPLES

Density of the rods formed in the hereinbelow examples was determined according to the following formula:

$$\text{Density (g/cc)} = \left[\pi \times \left[\left(\frac{OD}{2}\right)^2 - \left(\frac{ID}{2}\right)^2\right] \times \frac{\text{rod length}}{\text{rod weight}}\right]^{-1}$$

wherein OD is the outer diameter of the rod in centimeters, ID is the inner diameter of the rod in centimeters and the length and weight of the rod are in centimeters and grams respectively.

Pressure drop (P) was measured by blocking an open extruded tube at one end while inserting the other end in a pressure drop instrument (P.D.I.). The P recorded is inversely proportional to the air flow through the walls of the tube.

The following examples are illustrative of the invention.

EXAMPLE 1

Bright tobacco having an approximate moisture content of 11.06% OV was ground in a Fritsch-Pulverisette. The ground tobacco was passed through a 60-mesh screen to remove coarse particles and the fraction having a sieve size of 60 or smaller (−60 mesh) was selected for further processing.

To 224.9 g of the −60 mesh tobacco which has a moisture content of 11.06% OV, was added to 48.0 ml of 95% ethanol and 47.1 g water. This misture was stirred in a Hobart mixer (Model N-50) equipped with a conventional "B"-flat beater blade for approximately 20 minutes.

The tobacco mixture having a solids content of 64.5% by weight was then extruded to form tubes having a wall thickness of 0.5 mm. A Wayne Plastics 1" extruder with 1:1 compression ratio screw, 3 zone automatic heat, and 3 zone automatic fan cooling, straight tubing die having an 8 mm outer diameter (OD) and 7 mm inner diameter (ID) and 3 HP variable speed (0 to 60 rpm) drive (SCR) was employed to effect extrusion. Zones 1 through 3 were maintained at room temperature. The maximum die head pressure was 1500 psig. Although these extrusion conditions were favorable for small runs, for large, continuous runs it was necessary to cool the barrel to prevent skin formation on the rod.

Some of the extruded tobacco tubes were dried in an Appollo Microwave oven for 5 minutes at maximum power. After drying, the tubes were ignited and maintained a static burn.

Extruded tubes were also allowed to dry at room temperature overnight. These tubes were then cut into 85 mm lengths having an average measured weight of 12.70 mg/mm and a calculated density of 1.078 g/cc. Four of these tubes were allowed to static burn, and the average burn time was determined and found to be 4.8 mm/minute. Other room temperature dried tubes were smoked automatically under controlled laboratory conditions. TPM and tar delivery were measured using standard analytical techniques of the tobacco industry. The average TPM/Puff was 0.35 mg and the average tar/Puff was 0.28 mg.

EXAMPLE 2

677.7 g of bright tobacco (−60 mesh) having a moisture content of 11.56% OV was combined with 144 ml 95% ethanol and 138 g water. The mixture was stirred in a Hobart mixer for 30 minutes, covered and left at ambient temperature for 1.5 hours. The percent solids prior to extrusion was 65.82%.

The equipment and conditions for extrusion were identical to those of Example 1. The die pressure during the collection of samples was approximately 500 psig, and the maximum melt temperature of the extrudate at the die head was 110° F. The extruded tubes had an outer diameter of 8 mm and an inner diameter of 7 mm and a wall thickness of 0.5 mm.

The tubes were allowed to dry overnight at room temperature. Representative samples were cut to 85 mm lengths, having an average weight of 12.64 mg/mm. The calculated density was 1.073 g/cc. The static burn was determined as in Example 1 and found to be 3.52 mm/min. TPM and tar delivery/puff, also determined as in Example 1, were found to be 0.26 mg and 0.16 mg respectively.

In addition, the smoke from the third puff of four tobacco tubes was collected and their gas phase constituents measured using conventional gas chromatography techniques. The average gas concentrations of the third puff of the four samples was as follows:

$O_2$—9.61 mg/tube third puff
CO—0.07 mg/tube third puff
$CO_2$—1.11 mg/tube third puff Finally, average pressure drop of 5 representative 85 mm tubes was found to be 1.56 inches of $H_2O$.

EXAMPLE 3

564.7 g bright tobacco (−60 mesh) having a moisture content of 11.5 OV was combined with 120 ml of 95% ethanol and 115.3 g water in a manner identical to that used in Example 2. The mixture was stirred for 25 minutes and thereafter was allowed to stand covered overnight. Prior to extrusion, the mixture had a solids content of 65.05%.

The die of the extruder was modified to extrude a tobacco tube having an outer diameter of 8 mm and an inner diameter of 5 mm. Employing the equipment of Example 1, the extrusion conditions were as follows:

| | Extrusion Conditions | |
|---|---|---|
| Time | PSIG Head Pressure | Melt T °F. |
| 0 minutes | 0 | 75 |
| 5 minutes | 550 | 85 |
| 10 minutes | 450 | 98 |
| 15 minutes | 375 | 105 |
| 20 minutes | 375 | 106 |
| 25 minutes | 375 | 109 |
| 30 minutes | 375 | 110 |
| 34 minutes | 350 | 112 |

The extruded tubes were dried overnight at room temperature. Representative examples of tubes extruded between the time interval of 6 to 10 minutes were coded A and additional tubes extruded between approximately 23 and 28 minutes were coded B.

Representative tobacco tubes were analyzed and the results are tabulated in Table 1 below.

TABLE 1

| Units Example | mg/mm Rod Weight | g/cc Density | Inches of $H_2O$ Blank off P for 85 mm | mm/minute Static Burn Rate | mg TPM Puff | mg Tar Puff | mg Third Puff CO | mm Wall Thickness |
|---|---|---|---|---|---|---|---|---|
| 3A | 31.69 | 1.035 | 0.60 | 1.91 | 0.36 | 0.28 | 0.16 | 1.5 |
| 3B | 32.51 | 1.061 | 4.65 | 1.21 | 0.22 | 0.18 | 0.09 | 1.5 |

EXAMPLE 4

443.21 g Burley tobacco (−60 mesh) having a moisture content of 9.75% OV was stirred in a Hobart mixer with 96 ml of 95% ethanol and 100.8 g water for approximately 25 minutes. The mixture had a solids content of 64.5% prior to extrusion.

Burley tobacco tubes having an outer diameter of 8 mm and an inner diameter of 6.5 mm were extruded using the Wayne plastics extruder previously described and under conditions identical to Example 2 with the exception that the gearing on the extruder was changed to increase the range of rotation of the screw from 0–120 rpm. During extrusion the maximum head pressure was 2500 psig and the maximum melt temperature was 151° F.

EXAMPLE 5

440.8 g of Oriental tobacco (−60 mesh) having a moisture content of 9.25% OV was combined with 96 ml 95% ethanol and 103.2 g water. The mixture was stirred for 25 minutes and extruded using the same die as in Example 4. Extrusion conditions and equipment were identical to Example 4. The maximum head pressure was 600–700 psig and maximum melt temperature was 110° F. The tobacco tubes exiting the extruder die were found to be slightly sticky and were more flexible than either bright or burley tobaccos.

EXAMPLE 6

A blended tobacco tube was prepared using the following ingredients: 220.1 g bright tobacco at 9.12% OV, 110.8 g burley tobacco at 9.75% OV, 110.8 g Oriental tobacco at 9.25% OV, 96.0 ml 95% ethanol and 102.0 g water. All starting tobacco materials were −60 mesh.

The dry tobacco materials were blended in the Hobart mixer and the alcohol and water were added. After 25 minutes of mixing, the material was extruded as previously described in Example 4. The maximum head pressure was 950 psig and the maximum melt temperature was 112° F.

The blended extruded tobacco tubes exiting the die appeared to be more flexible than a tube of all bright tobacco tube but less flexible than a tube of all burley or all Oriental tobacco.

EXAMPLE 7

An all bright tobacco tube was extruded using the same procedure and die as in Example 4. The ingredients employed were 440.1 g bright tobacco (−60 mesh) at 9.12% OV, 96.0 ml 95% ethanol and 103.9 g water.

During extrusion, the maximum head pressure reached 1400 psig and the maximum melt temperature was 116° F.

EXAMPLE 8

The following tobacco constituents were blended in a Hobart mixer:

220.1 g bright tobacco (−60 mesh) at 9.12% OV
110.8 g burley tobacco (−60 mesh) at 9.75% OV
110.2 g Oriental tobacco (−60 mesh) at 9.25% OV To the tobacco mixture was added in an alternating manner 102.9 g water and 26.0 ml of a cigarette flavorant solution in 70 ml of ethanol. The flavorant solution typically contains humectants and flavorants routinely used in tobacco processing. After all the solutions were added, the total mixture was stirred for an additional 25 minutes.

The tobacco mixture having a total solids content of 64.5% was then extruded using the Wayne Plastics 1" extruder. Zones 1 through 3 were maintained at room temperature during extrusion. The maximum head pressure was 950 psig and the maximum melt temperature was 127° F. The extruded tubes, having an outer diameter of 8 mm and an inner diameter of 6.5 mm, appeared to be very pliable as they exited the die.

EXAMPLE 9

In a manner similar to Example 8, the following ingredients were combined and mixed in a Hobart mixer:
220.1 g bright tobacco (−60 mesh) at 9.12% OV
110.8 g burley tobacco (−60 mesh) at 9.75% OV
110.2 g Oriental tobacco (−60 mesh) at 9.25% OV
10.0 g mixed sugar solution
96.0 ml 95% ethanol
92.9 g water The water and ethanol were mixed and added to the tobacco materials in an alternating manner with the sugar solution. Mixing continued for 25 minutes after all ingredients were added. The percent solids was 64.5%.

Tobacco tubes were extruded in a manner identical to that of Example 8. During extrusion, the maximum head pressure was 900 psig and the maximum melt temperature was 126° F.

The extruded tubes were dried in an oven at 100° C. overnight. Sample tubes lighted immediately after removal from the oven would maintain a static burn. Tubes which had been dried in the oven and then equilibrated at room temperature would also static burn, although some tended to go out and required relighting.

EXAMPLE 10

The following ingredients were combined and mixed in a Hobart mixer:
286.1 g bright tobacco (−60 mesh) at 9.12% OV
110.8 g burley tobacco (−60 mesh) at 9.75% OV
44.1 g Oriental tobacco (−60 mesh) at 9.25% OV
10.0 g mixed sugar solution
13.0 ml flavorant solution (humectant and flavorants)
92.2 ml 95% ethanol
106.4 g water The materials were blended approximately 25 minutes following addition of all ingredients. The percent solids was 64.5%. Extrusion of tobacco tubes having an 8 mm outer diameter and 6.5 mm inner diameter was conducted under identical conditions described in Example 8. The maximum head pressure noted was 700 psig and the maximum melt temperature was 126° F.

Selected representative tubes were dried overnight in an oven at 100° C. The dried tubes successfully burned. Tubes that had been dried and equilibrated at ambient room temperature would also static burn. It was noted on burning that a distinctive cigar aroma was produced by the tobacco tube.

EXAMPLE 11

Representative extruded tubes from Example 4 through 7 were dried in an oven at 100° C. overnight. One-half of the tubes were lit immediately after removal from the oven to determine whether a static burn could be maintained. The remaining half were equilibrated at room temperature overnight and then tested for static burn. The results are set forth in Table 2.

TABLE 2

| Example | Dried | Dried and Equilibrated |
|---|---|---|
| 4 | Burned | Burned |
| 5 | No Static Burn | No Static Burn |
| 6 | Burned | Burned |

TABLE 2-continued

| Example | Dried | Dried and Equilibrated |
|---|---|---|
| 7 | Burned | Burned |

The tobacco tubes prepared in Examples 5 and 8 would not maintain a satisfactory static burn. However, when the extruded tubes were subjected to the water treatment described below, it was found that substantially improved combustion properties were obtained.

Extruded tubes were cut to a length of 100 mm and were then submerged in water so that a length of 50 mm per tube became wet. The tubes were dried in a microwave oven and conventional cellulose acetate filters were attached to each tube. The static burn rate and length of tube which burned were determined. The results are tabulated below in Table 3.

TABLE 3

| Sample | Time Submerged Seconds | Static Burn Rate | Length Burned |
|---|---|---|---|
| Example 5 | 30 | no burn | — |
| Example 5 | 45 | no burn | — |
| Example 5 | 60 | 0.75 | 10 mm |
| Example 5 | 90 | 1.81 | 50 mm |
| Example 8 | 30 | 2.58 | 50 mm |

EXAMPLE 13

433.1 g of bright tobacco (−60 mesh) having 7.46% OV was combined with 96 g of 95% methanol and 110.9 g water. The material was mixed in a Hobart mixer for 25 minutes at room temperature.

The tobacco mixture, having approximately 62.5% solids, was extruded using a Wayne plastic extruder equipped with an 8 mm outer diameter and 7 mm inner diameter tubing die. Extrusion conditions were identical to those employed in Example 4. The pressure in the extruder increased to 1,200 psi as the first tubes were collected and when the extrusion was terminated 17 minutes later the pressure was recorded at 1,000 psi.

The hollow, extruded tubes were dried overnight at room temperature. The outer walls of the tubes appeared to be very smooth and dense. Attempts to static burn the tubes were unsuccessful.

Extruded tubes, 100 mm in length, prepared as above were immersed in water to a depth of 50 mm for varying periods of time. The tubes were thereupon dried in a microwave oven for two minutes. The pressure drop of each tube was determined prior to and after water treatment. The results are shown in Table 4.

TABLE 4

| Time Submerged Seconds | Pressure Drop Before | Inches of $H_2O$ After |
|---|---|---|
| 5 | 60.99 | 60.54 |
| 10 | 60.50 | 57.71 |
| 15 | 60.62 | 52.07 |
| 20 | 60.57 | 16.48 |
| 25 | 60.71 | 10.21 |
| 30 | 60.05 | 5.70 |

The results indicate that water treatment significantly modifies the tube wall thereby decreasing the pressure drop.

EXAMPLE 14

In a manner similar to Example 13, the following materials were combined and mixed in the Hobart mixer to form a mixture having 62.5% solids which was extruded using the Wayne plastics extruder:
324.8 g bright tobacco (−60 mesh) at 7.65% OV
72.0 g 95% n-propyl alcohol
83.2 g water The initial material that exited the extruder appeared to be quite dry. Extrusion continued for approximately 15 minutes; production of tubing was slower than normally observed. The extruded hollow tubes were dried overnight at room temperature. The tubes, when ignited, would static burn.

EXAMPLE 15

In a manner similar to Example 13, the following ingredients were combined and mixed to form a mixture having 62.5% solids which was extruded using the Wayne Plastics extruder:
324.8 g bright tobacco (−60 mesh) at 7.64% OV
72.0 g 95% isopropyl alcohol
83.0 g water The pressure in the extruder rose to 1,300 psi during extrusion. The extruded hollow tubes had good mechanical properties. After drying overnight at room temperature, the tubes were tested for static burn. The tubes would not maintain static burn under normal testing conditions.

EXAMPLE 16

In a manner similar to Example 13, the following materials were combined and mixed for 25 minutes to form a mixture having 62.5% solids which was extruded under identical conditions described previously:
324.8 g bright tobacco (−60 mesh) at 7.64% OV
72.0 g 95% isobutyl alcohol
83.2 g water The mixture was fed to the extruder hopper and the extruder was started. Liquid began to appear at the die opening; however, the tobacco material would not extrude. Apparently isobutyl alcohol was not compatible with the tobacco mixture at the above-noted proportion. The tobacco remaining in the die was dry and it appeared that the solvent and water had been squeezed from the tobacco.

EXAMPLE 17

In a manner similar to Example 13, the following materials were combined, mixed 25 minutes and then extruded:
324.8 g bright tobacco (−60 mesh) at 7.64% OV
72.0 g 95% tert-butyl alcohol
83.2 g water During extrusion the pressure varied between 1,100 psig and 1475 psig. The hollow tubes extruded appeared to have poor mechanical properties when wet. The solvent tended to evaporate rapidly on exiting the die and the tubes turned lighter in color as the solvent evaporated. After drying overnight, the extruded tubes were tested for static burn. After burning for approximately 2 minutes, the tube went out.

EXAMPLE 18

Using the procedure of Example 13, the following materials were combined and mixed to form a 62.5% solid mixture which was extruded:
324.8 g bright tobacco (−60 mesh) at 7.64% OV
72.0 g 95% methylene chloride
83.2 g water During extrusion the pressure rose to about 1,500 psi. The mechanical properties of the extruded hollow tubes were excellent. The tubes exhibited a high degree of plasticity and could be stretched without rupturing. Lengths greater than one meter could be extruded successfully. The dried tubes would not maintain static burn.

EXAMPLE 19

Using the procedure of Example 13, the following materials were combined and mixed to form a mixture having 62.5% solids which was extruded:
332.2 g bright tobacco (−60 mesh) at 9.7% OV
34.2 g methylene chloride
36.0 g ethanol
77.0 g water On extrusion, the tubes exhibited some plasticity; however, it was not as great as observed when methylene chloride was used as the major solvent.

EXAMPLE 20

Representative tubes prepared in Examples 13, 15, 17, 18 and 19 were cut to a length of 100 mm. The tubes were immersed in water for 30 seconds in such a manner that exactly 50 mm of each tube came in contact with the water. The tubes were dried for 2 minutes in CEM Corp. Model AVC-MP microwave oven at maximum power. Conventional cellulose acetate filters were attached to the untreated end of each tube after drying. The tubes were secured by the filter end and the water treated end was ignited. The static burn rate was based on the time required to burn the 50 mm water treated portion of the tube. The results are tabulated below in Table 5.

TABLE 5

| Solvent and Tobacco | Static burn Rate mm/min |
|---|---|
| Methyl Alcohol | 1.85 |
| Isopropyl Alcohol | 3.64 |
| Tert-Butyl Alcohol | 2.13 |
| Methylene Chloride | 0.68[1] |
| Methylene Chloride-Ethanol 1:1 | 2.42 |

[1]The tube immersed for 30 seconds would not static burn. After immersion for 45 seconds, the tube burned for 8 minutes 5 seconds and went out. After relighting the tube burned for an additional 6 minutes 35 seconds. Total length burned was 10 mm.

The results indicate that when dried extruded tobacco tubes are subjected to a water treatment, the tube wall is modified in such a manner that combustion properties of the tube are improved.

EXAMPLE 21

The following ingredients were combined and mixed in a Hobart mixer for approximately 25 minutes:
154.05 g bright tobacco (−60 mesh) at 9.15% OV
61.53 g PCB* carbon (−40+60 mesh) at 2.48% OV
48.0 ml 95% ethanol
56.4 g water
*PCB=Pittsburgh Coal Carbon−40+60 mesh The tobacco-carbon mixture having 64.5% solids was dark but appeared to have the same consistency as previous mixtures used.

Using extrusion conditions from Example 8, tobacco-carbon tubes were produced wherein the outer diameter was 8 mm and the inner diameter was 6.5 mm. During extrusion the maximum head pressure was 2000 psig and the maximum melt temperature was 106° F.

After drying overnight, the tobacco-carbon tubes would maintain a static burn.

EXAMPLE 22

Tobacco-carbon tubes wherein carbon represented approximately 40% of the total solids in the formulation were prepared using the following ingredients:
206.7 g bright tobacco (−60 mesh) at 9.12% OV
130.3 g PCB carbon (−60+140 mesh)
75.1 ml 95% ethanol
88.7 g water (64.5% solids)

Tobacco-carbon tubes were extruded wherein the outer diameter was 8 mm and the inner diameter was 5 mm. The Wayne plastics extruder was modified to include a low restriction spider to improve flow properties.

The extruder conditions were as follows:
Zone 1—100° F.
Zone 2—150° F.
Zone 3—200° F.
Die—250° F.
Screw Speed 120 rpm During extrusion the head pressure built up to about 600 psig and this was followed by rapid extrusion of tube product. As the pressure dropped, tube production ceased; however, with pressure build up, product was again extruded.

Samples of extruded tubes were dried overnight and tested for static burn. All samples maintained a static burn.

EXAMPLE 23

The following ingredients were combined and mixed in a Hobart mixer:
154.0 g bright tobacco (−60 mesh) at 9.12% OV
60.0 g calcium carbonate at 0.06% OV (−50 mesh)
48.0 ml 95% ethanol
57.9 g water (64.5% solids)

After mixing for 25 minutes, tobacco tubes were extruded using the conditions described in Example 8. The maximum head pressure reached 1000 psig during extrusion. The extruded tubes appeared to have a diameter slightly larger than 8 mm. This may be due to minimal expansion caused by the carbonate salt.

EXAMPLE 24

Bright tobacco, 222.3 g, −60 mesh at 10.09% OV, was combined with 84.8 g of water and mixed in a Hobart mixer for 1 hour and 20 minutes. Fifty g of ammonium carbonate at 20% OV was added and the mixture was stirred for 10 minutes.

The material was extruded using the Wayne plastic extruder under the following conditions: Zone 1—30° C.; Zone 2—50° C.; Zone 3—70° C.; Die 100° C.; Feed Cooling Water on; Straight Tubing Die (8 mm outer diameter, 7 mm inner diameter).

No die head pressure was observed: The die temperature was reduced to 90° C. during extrusion.

A representative example of the extruded tubes, cut to a 85 mm length, was equilibrated overnight to 60° RH in a humidity cabinet. On ignition with a gas flame, the hollow tube maintained a static burn for over 6 minutes. A 20 mm section of the tube had a burn rate of 0.185 mm/second.

EXAMPLE 25

200.2 g bright tobacco (−40+60 mesh) at 10.0% OV and 150.0 g tobacco slurry containing diammonium phosphate at 18.0% solids prepared according to U.S. Pat. No. 3,353,541 were blended in a Hobart mixer for 2 hours to give a mixture having approximately 59.12% solids.

The material, which tended to form small balls, was successfully extruded using the Wayne Plastics extruder. All three zones and the die were initially at room temperature and no cooling was used during extrusion. Screw speed was between 30 to 60 rpm; head pressure was 700 psig.

Extrusion was stopped and the die temperature was raised to 100° C. Additional tubes having 8 mm outer diameter and 7 mm inner diameter were successfully extruded.

Upon ignition with a gas flame, a sample tube static burned for approximately 3 minutes, 20 seconds.

EXAMPLE 26

222.3 g of bright tobacco (−60 mesh) having a moisture content of 10.05% was combined with 177.7 g water. The mixture was stirred in a Hobart mixer for 1.5 hours.

The tobacco mixture having a solids content of 50% by weight was then fed into the extruder hopper and an attempt was made to extrude 8 mm O.D.×7 mm I.D. hollow tobacco tubes.

The extruder temperature controllers were set as follows:
Zone 1 50° C.
Zone 2 70° C.
Zone 3 90° C.
Die 200° C.
Hopper cooling water on The extruder used in this experiment was a Wayne Machine & Die Co. yellow jacket table top extruder with a one inch barrel. The extruder was supplied with four automatic temperature controls, three zones on the barrel and one on the die, water cooled hopper feed, cooling fans mounted on barrel, a 1:1 extrusion screw, and a 0–10,000 psi Gentron No. GT-90 pressure gauge.

The tobacco mixture would not extrude using the above temperature conditions.

The temperature was reduced to 110° C. and a small amount of tobacco was extruded, but not in tube form. Upon cleaning the extruder, it was noted that the tobacco mixture had plugged the die.

EXAMPLE 27

222.3 g of bright tobacco (−40 mesh) having a moisture content of 10.05% was combined with 111.0 g water. The mixture was stirred in a Hobart mixer for 1.5 hours.

The tobacco mixture having a solids content of 50% by weight was then fed into the hopper of the extruder described in Example 1 and an attempt was made to extrude 8 mm O.D.×7 mm I.D. hollow tobacco tubes.

The initial temperatures controller settings were as follows:
Zone 1 30° C.
Zone 2 50° C.
Zone 3 70° C.
Die 100° C.
Hopper cooling water on Tobacco tubes were extruded under these conditions. Steam was noted to exit the die during extrusion. The temperature of Zone 3 was then raised to 100° C. Tobacco tubes were extruded under these conditions and more steam was noted to exit the die than at the 70° C. setting.

The temperature of the die was then raised to 140° C. Tobacco tubes were extruded under these conditions. Steam was noted to exit the die and the exterior surface of the extruded tubes was more irregular (not smooth) than under previous conditions. None of the samples extruded under the above extrusion conditions would maintain static burning.

EXAMPLE 28

224.9 g of bright tobacco (−20+40 mesh) having a moisture content of 11.06% was combined with 17.5 g water. The mixture was stirred in a Hobart mixer for 2 hours.

The tobacco mixture having a solids content of 50% by weight was then fed into the extruder hopper and an attempt was made to extrude 8 mm O.D.×7 I.D. hollow tobacco tubes.

The extruder temperature controllers were set as follows:

Zone 1 ambient
Zone 2 ambient
Zone 3 ambient
Die off
Hopper cooling water off

Ambient temperature settings were obtained by positioning the controller setting to such a position that the controller was supplying neither heat nor cooling. For this experiment, ambient temperature was 21° C.

The tobacco mixture would not extrude under these conditions.

EXAMPLE 29

224.9 g of bright tobacco (−20+40 mesh) having a moisture content of 11.06% was combined with 108.43 g water. The mixture was stirred in a Hobart mixer for 2.0 hours.

The tobacco mixture having a solids content of 60% by weight was then fed into the extruder hopper and an attempt was made to extrude 8 mm O.D.×7 mm I.D. hollow tobacco tubes. The extruder temperature controllers were set the same as in Example 28. There was no hopper cooling water.

The tobacco mixture would not extrude under these conditions. The die temperature was then raised to 100° C. A small amount of tobacco was extruded, but the tubes collapsed when placed on a paper towel.

EXAMPLE 30

112.5 g of bright tobacco (−40+60 mesh) having a moisture content of 11.06% was combined with 61.33 g water and 17.0 g 95% ethanol. The mixture was stirred in a Hobart mixer for 1.25 hours. 112.5 g of bright tobacco (−20+40 mesh) having a moisture content of 11.06% was then added to the mixture and stirred for an additional 0.25 hour. The tobacco mixture having a solids content of 65.9% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded, placed on paper towels and allowed to dry in room air overnight. The tubes would maintain static burn when dried.

EXAMPLE 31

224.9 g of bright tobacco (−40+60 mesh) having a moisture content of 11.06% was combined with 39.71 g water and 33.99 g ethanol. The mixture was stirred in a Hobart mixer for 1 hour.

The tobacco mixture having a solids content of 67% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded. When the tubes were allowed to air dry overnight, they would not maintain static burn.

EXAMPLE 32

224.9 g of bright tobacco (−40+60 mesh) having a moisture content of 11.06% was combined with 55.1 g water and 42.08 g ethanol. The mixture was stirred in a Hobart mixer for 1 hour.

The tobacco mixture having a solids content of 62.1% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded. When the tubes were allowed to air dry overnight, they would not maintain static burn.

EXAMPLE 33

224.9 g of bright tobacco (−60 mesh) having a moisture content of 11.06% was combined with 65.3 g ethanol. The mixture was stirred in a Hobart mixer for 1 hour.

The tobacco mixture having a solids content of 68.9% by weight was then fed into the extruder hopper in an attempt to extrude 8 mm O.D.×7 mm I.D. hollow tobacco tubes. The extrusion conditions were exactly the same as Example 28. The tobacco mixture would not extrude under these conditions.

EXAMPLE 34

344.27 g of bright tobacco (−40+60 mesh) having a moisture content of 12.9% was combined with 63.73 g water and 56.81 g ethanol. The mixture was stirred in a Hobart mixer for 25 minutes. The mixture was then sealed in the mixing container and allowed to stand for 1.25 hours.

The tobacco mixture having a solids content of 64.5% by weight was then fed into the extruder hopper in an attempt to extrude 8 mm O.D.×7 mm I.D. hollow tobacco tubes. The extrusion conditions were exactly the same as Example 28.

Hollow tobacco tubes were extruded under these conditions but the tubes disintegrated shortly after exiting the extruder die. The tobacco particles were not bound together by the extrusion process.

EXAMPLE 35

1,092.2 g of bright tobacco (−60 mesh) having a moisture content of 8.44% was combined with 268.3 g water and 189.9 g 95% ethanol. The mixture was stirred in a Hobart mixer for 35 minutes.

The tobacco mixture having a solids content of 64.5% by weight was then divided into two parts. Approximately threefourth's of the mixture was fed into the extruder referred to in Example 26 and one-fourth of the mixture was placed in the hopper feeder of a Wayne plastics extruder Model No. 2417. The Model No. 2417 extruder was modified to take a one inch water cooled barrel, a one inch 1:1 extrusion screw, and an automatic hopper feeder. It was mated to the extruder referred to in Example 26 via a modified Wayne Machine and Die Co. crosshead die.

The Model No. 2417 extruder was then operated in such a manner as to sequentially extrude the tobacco mixture into the open passage of coextruded hollow tobacco tubes which were being extruded by the extruder mentioned in Example 26. The sequential extrusion of the tobacco mixture into the 8 mm O.D.×7 mm I.D. tubes resulted in the plugs, approximately 5 mm in length, located at approximately 70 mm intervals along the longitudinal axis of the hollow tubes. The extrusion conditions of the hollow tubes were the same as those of Example 26 with the exception of the use of the crosshead die and coextrusion.

Some samples from this extrusion were placed in a CEM Model AUC-MP microwave oven and dried at one-half power for five minutes. The samples so dried would maintain static burn.

Additional samples of extrudate were allowed to air dry on a paper towel overnight. These samples were then cut into smokable lengths by cutting the tube samples at the midpoint of each plug resulting in samples 75 mm in length with tobacco plugs of 2.5 mm thickness, located at each end. Several small holes were then drilled longitudinally through the plugged ends of the samples using number 80 and number 69 drill bits to enable the samples to be puffed on by a smoker. Cellulose acetate filters approximately 20 mm in length were then attached to one end of the samples with cellophane tape.

These samples would not maintain static burn. The samples were then dipped into water for two seconds and allowed to dry in room air overnight. After drying, the samples would maintain static burn and could be smoked.

EXAMPLE 36

327.2 g of bright tobacco (−60 mesh) having a moisture content of 8.44% was combined with 81.67 g water, 57.4 g 95% ethanol and 3.03 g tert butyl-p-menthanecarboxamide. The mixture was stirred in a Hobart mixer for 25 minutes.

The tobacco mixture having a solids content of 64.5% by weight was then divided into two parts and extruded under the same conditions as Example 35.

Plugged tube samples extruded in this manner were dried in a microwave oven the same as in Example 28. These samples would maintain static burn.

Smokable samples were produced from air dried extrudate by the same procedure used in Example 35. These samples would not maintain static burn but would burn sufficiently so that they could be lit and smoked in a normal manner. A methanol-like cooling was detected when these samples were smoked.

EXAMPLE 37

338.8 g of bright tobacco (−60 mesh) having a moisture content of 11.46% was combined with 69.2 g water and 56.8 g 95% ethanol. The mixture was stirred in a Hobart mixer for 35 minutes.

The tobacco mixture was fed into the extruder referred to in Example 26 and 8 mm O.D.×7 mm I.D. hollow tobacco tubes were extruded under the same conditions as Example 28.

Samples of the extrudate were placed on paper towels and allowed to dry in room air overnight.

Some samples collected during the time interval of 5.5 minutes to 7.0 minutes of extrusion were selected for analysis. The results of the analysis were as follows:

| | |
|---|---|
| Sample weight | 12.96 mg/mm |
| Wall density | 1.100 g/cc |
| Blank off P 85 min. | 3.94 inches $H_2O$ |
| Static burn rate | 23.46 mm/min |
| TPM/Puff | .16 mg |
| Tar/Puff | .10 mg |
| Third Puff CO delivery | .03 mg |

EXAMPLE 38

451.8 g of bright tobacco having a moisture content of 11.46% was combined with 92.2 g water and 75.7 g 95% ethanol. The mixture was stirred in a Hobart mixer for 25 minutes.

The tobacco mixture having a solids content of 64.5% by weight was then fed into the extruder referred to in Example 26. The die of the extruder of Example 26 was modified to extrude 8 mm O.D.×6 mm I.D. hollow tubes. The extrusion conditions were the same as Example 28.

The extruded tobacco tubes were placed on paper towels to dry overnight in room air.

Extrudate samples collected during the time interval of 5.5 minutes to 7.5 minutes of extrusion were selected for analysis. The results of the analysis were as follows:

| | |
|---|---|
| Sample weight | 19.87 mg/mm |
| Wall density | .904 g/cc |
| Blank off P 85 min. | 6.77 inches $H_2O$ |
| Static burn rate | 31.20 mm/min |
| TPM/Puff | .21 mg |
| Tar/Puff | .17 mg |
| Third Puff CO delivery | .06 mg |

What is claimed is:

1. A method of producing smoking articles comprising:

mixing combustible tobacco material with one or more other ingredients including a liquid to provide a tobacco mixture;

shaping the mixture under pressure into a discrete coherent mass;

providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

2. The method of claim 1 wherein said through passage is provided during the shaping operation.

3. The method of claim 1 wherein said through passage is provided subsequent to the shaping operation.

4. A method of producing smoking articles comprising:

mixing combustible tobacco material with one or more other ingredients including water and a volatile organic liquid to provide a tobacco mixture;

shaping the mixture under pressure into a discrete coherent mass;

providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

5. A method of producing smoking articles comprising:

mixing combustible tobacco material with one or more other ingredients including a liquid to provide a tobacco mixture;

shaping the mixture under pressure into a discrete coherent mass by extrusion;

providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

6. A method of producing smoking articles comprising:

mixing combustible tobacco material with one or more other ingredients including a liquid to provide a tobacco mixture having a solids content of about 55 to 75 weight percent solids;

shaping the mixture under pressure into a discrete coherent mass; and providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

7. A method of producing smoking articles comprising:

mixing combustible tobacco material with one or more other ingredients including a liquid to provide a tobacco mixture, said ingredients being non-binder materials;

shaping the mixture under pressure into a discrete coherent mass;

providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

8. A method of producing smoking articles comprising:

mixing combustible comminuted tobacco material with one or more other ingredients including a liquid to provide a tobacco mixture;

shaping the mixture under pressure into a discrete coherent mass;

providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

9. A method of producing smoking articles comprising:

mixing combustible comminuted tobacco material with one or more other ingredients including water and a volatile organic liquid to provide a tobacco mixture having a solids content of about 55 to 75 weight percent solids;

shaping the mixture under pressure into a discrete coherent mass by extrusion;

providing at least one passage through said mass; and drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

10. The method of claim 1 or 9 wherein said one or more other ingredients include non-tobacco filler particles.

11. The method of claim 10 wherein the filler particles are selected from the group consisting of carbon, calcium carbonate, diatomaceous earth and attapulgite.

12. The method of claim 10 wherein the filler particles comprise up to about 50 percent of the solids content of said mixture.

13. The method of claim 1 or 9 wherein said one or more other ingredients include burn additives.

14. The method of claim 1 or 9 wherein said one or more other ingredients include flavorants.

15. The method of claim 1 or 9 wherein said mixing is carried out for a time sufficient to obtain a substantially homogenous mixture of said tobacco material and said one or more other ingredients.

16. The method of claim 15 wherein said mixing is carried out for about 15 minutes to several hours.

17. The method of claim 1 or 9 wherein said drying is effected by subjecting said shaped mass to heat.

18. The method of claim 17 wherein said drying is effected by applying hot air to said shaped mass.

19. The method of claim 18 wherein the air is heated to a temperature of about 100° C. and drying is effected for a period of about 15 minutes to 1 hour.

20. The method of claim 17 wherein said drying is effected by subjecting said shaped mass to microwave energy.

21. The method of claim 20 wherein said microwave energy is at a preselected power level and is applied for a preselected time.

22. The method of claim 1 or 9 wherein said drying is effected by subjecting said shaped mass to ambient atmosphere.

23. The method of claim 22 wherein said ambient atmosphere is at a temperature within the range of 70° F. to 75° F. and said shaped mass is subjected to said atmosphere for a period of time in the range of 12 to 24 hours.

24. The method of claim 1 or 9 further comprising:

rewetting said dried mass; and redrying said rewetted mass.

25. The method of claim 24 wherein rewetting is carried out for a period of time sufficient to obtain a desired porosity for said mass.

26. The method of claim 1 or 9 further comprising the step of inserting one or more porous readily ignitable plugs into the passage of said mass.

27. The method of claim 26 wherein at least one of said plugs contains a flavorant.

28. The method of claim 4 or 9 wherein said volatile liquid is a low molecular weight alcohol compatible with tobacco.

29. The method of claim 28 wherein said volatile liquid is ethanol.

30. The method of claim 4 or 9 wherein the ratio of volatile organic liquid to water is from about 1:6 to about 1:1.

31. The method of claim 30 wherein the ratio of volatile organic liquid to water is about 1:2 to 1:1.

32. The method of claim 4 or 9 wherein said mixing is conducted in a closed container to prevent volatilization of said organic liquid.

33. The method of claim 5 or 9 wherein said extrusion is carried out in such manner that a minimum working of the tobacco occurs while sufficient pressure is applied thereto to release the natural binding agents contained in the tobacco material.

34. The method of claim 5 or 9 further comprising:
force feeding said tobacco mixture to the extrusion mechanism.

35. The method of claim 5 or 9 wherein said extrusion is carried out with a screw extruder.

36. The method of claim 35 wherein the extruder has a 1:1 screw.

37. The method of claim 35 wherein the extrusion of said tobacco mixture is at a melt pressure equal to or less than 2500 psi.

38. The method of claim 37 wherein the extrusion of said tobacco mixture is at a melt pressure equal to or less than 1200 psi.

39. The method of claim 38 wherein the temperature of said tobacco mixture during extrusion is at or below a melt temperature of 40° C.

40. The method of claim 5 or 9 wherein the extrusion of said tobacco mixture is carried out with a ram extruder operation.

41. The method of claim 5 or 9 further comprising:
inserting one or more porous readily ignitable plugs into said passage by extruding plug material into said passage.

42. The method of claim 6 or 9 wherein the tobacco mixture has a solids content of about 60 to 70 weight percent solids.

43. The method of claim 8 or 9 wherein said tobacco material has a mesh size of less than about 30 mesh.

44. The method of claim 43 wherein the tobacco material has a mesh size of less than about 60 mesh.

45. The method of claim 8 or 9 further comprising:
comminuting said tobacco material prior to mixing said tobacco material.

46. A method of producing smoking articles comprising:
mixing combustible tobacco material with one or more other ingredients including a liquid to provide a tobacco mixture;
shaping the mixture under pressure into a discrete coherent mass by extrusion, said extrusion being carried out such as to provide a substantially cylindrically shaped mass;
providing at least one passage through said mass; and
drying said shaped mass,
the mixture composition being selected and the shaping pressure and drying being controlled to impart to said shaped mass a porosity and density such as to substantially occlude gas flow therethrough and a porosity sufficient to support combustion of said shaped mass when ignited.

47. A method of producing smoking articles comprising:
mixing combustible comminuted tobacco material with one or more other ingredients including water and a volatile organic liquid to provide a tobacco mixture having a solids content of about 55 to 75 weight percent solids;
shaping the mixture under pressure into a discrete coherent mass by extrusion, said extrusion being carried out such as to produce a substantially cylindrically shaped mass;
providing at least one passage through said mass; and
drying said shaped mass,
the mixture composition being selected and the shaping pressure and drying being controlled to impart to said shaped mass a porosity and density such as to substantially occlude gas flow therethrough and a porosity sufficient to support combustion of said shaped mass when ignited.

48. The method of claim 46 or 47 wherein said passage extends along the axis of said cylindrically shaped mass.

49. The method of claim 48 wherein the cross-sectional area of said shaped mass is less than the corresponding cross-sectional area of said passage.

50. The method of claim 49 wherein said passage is defined by an inner surface of said shaped mass.

51. A method of producing smoking articles comprising:
mixing combustible tobacco material with one or more other ingredients including a liquid to provide a tobacco mixture;
shaping the mixture under pressure into a discrete coherent mass by extrusion;
providing at least one passage through said mass;
inserting one or more porous readily ignitable plugs into said passage by concurrently extruding plug material into said passage; and
drying said shaped mass,
the mixture composition being selected and the shaping pressure and drying being controlled to impart to said shaped mass a porosity and density such as to substantially occlude gas flow therethrough and a porosity sufficient to support combustion of said shaped mass when ignited.

52. A method of producing smoking articles comprising:
mixing combustible comminuted tobacco material with one or more other ingredients including water and a volatile organic liquid to provide a tobacco mixture having a solids content of about 55 to 75 weight percent solids;
shaping the mixture under pressure into a discrete coherent mass by extrusion;
providing at least one passage through said mass;
inserting one or more porous readily ignitable plugs into said passage by concurrently extruding plug material into said passage; and
drying said shaped mass, the mixture composition being selected and the shaping pressure and drying being controlled to impart to said shaped mass a porosity and density such as to substantially occlude gas flow therethrough and a porosity sufficient to support combustion of said shaped mass when ignited.

53. The method of claim 51 or 52 wherein the extrusion of said plug material is carried out intermittently.

54. The method of claim 53 further comprising:

cutting said mass transverse to the axis of said passage at positions at which said plug material is located in said passage.

55. The method of claim 54 wherein said cutting is through said plug material.

56. The method of claim 54 wherein said cutting occurs concurrently with extrusion.

57. The method of claim 56 wherein said cutting is synchronized with the extrusion of said tobacco mixture to provide sections of said mass having preselected length and having plug material therein of preselected expanse.

58. The method of claim 51 or 52 further comprising:

applying force to the wall of said extruded tobacco mixture to cohesively join said tobacco mixture to said extruded plug material.

59. The method of claim 51 or 52 further comprising:

allowing the plug material to expand and cohesively join itself to the wall of said extruded tobacco mixture.

* * * * *

UNITED STATES PATENT AND TRADEMARK OFFICE

CERTIFICATE OF CORRECTION

PATENT NO. : 4,347,855

DATED : September 7, 1982

INVENTOR(S) : Lanzillotti et al.

It is certified that error appears in the above—identified patent and that said Letters Patent is hereby corrected as shown below:

Title Page, Col. 2, change "3,349,779" to -- 3,349,776 -- ; and change "4,126,309" to -- 4,120,309 -- .

Col. 4, line 32, change "generaly" to -- generally -- .

Col. 6, line 51, insert after "general", the following -- , -- .

Col. 6, line 52, change "inital" to -- initial -- .

Col. 8, line 15, change "by" to -- be -- .

Col. 8, line 29, change "11" to -- 111 -- .

UNITED STATES PATENT AND TRADEMARK OFFICE

CERTIFICATE OF CORRECTION

PATENT NO. : 4,347,855

DATED : September 7, 1982

INVENTOR(S) : Lanzillotti et al.

It is certified that error appears in the above—identified patent and that said Letters Patent is hereby corrected as shown below:

Col. 10, line 11, change "misture" to -- mixture -- .

Col. 14, line 5, insert -- EXAMPLE 12 -- .

Col. 21, line 1, change "threefourth's" to -- three-fourth's -- .

Signed and Sealed this

Twenty-sixth Day of April 1983

[SEAL]

Attest:

GERALD J. MOSSINGHOFF

Attesting Officer

Commissioner of Patents and Trademarks